US008011070B2

(12) United States Patent
Miyazaki

(10) Patent No.: US 8,011,070 B2
(45) Date of Patent: Sep. 6, 2011

(54) CURVED SLIDE FASTENER

(75) Inventor: Yuichi Miyazaki, Toyama-ken (JP)

(73) Assignee: YKK Corporation, Tokyo (JP)

( * ) Notice: Subject to any disclaimer, the term of this patent is extended or adjusted under 35 U.S.C. 154(b) by 986 days.

(21) Appl. No.: 11/973,409

(22) Filed: Oct. 9, 2007

(65) Prior Publication Data

US 2008/0086851 A1 Apr. 17, 2008

(30) Foreign Application Priority Data

Oct. 12, 2006 (JP) ..... 2006-279130

(51) Int. Cl.
*A44B 19/24* (2006.01)
*A44B 19/34* (2006.01)

(52) U.S. Cl. ..... 24/381; 139/384 B; 24/403; 24/385

(58) Field of Classification Search ..... None
See application file for complete search history.

(56) References Cited

U.S. PATENT DOCUMENTS 1,322,650 A * 11/1919 Sundback ..... 24/403
2,070,753 A * 2/1937 Schatzky ..... 24/417
2,909,823 A * 10/1959 Armstrong ..... 24/389
3,003,212 A * 10/1961 Emery ..... 139/384 B
3,725,983 A * 4/1973 Selvaggi ..... 24/403
4,000,545 A * 1/1977 Takamatsu ..... 24/404
4,502,302 A 3/1985 Matsuda
5,065,491 A 11/1991 Takada
2002/0092139 A1* 7/2002 Horikawa ..... 24/381

FOREIGN PATENT DOCUMENTS

JP B2-7-59205 6/1995

* cited by examiner

*Primary Examiner* — Jack W. Lavinder
(74) *Attorney, Agent, or Firm* — Alston & Bird LLP

(57) ABSTRACT

A curved slide fastener in which a convex element attaching edge portion which is curved convexly and outwardly and a concave element attaching edge portion which is curved concavely and inwardly are arranged to face each other on opposing side edges of a pair of fastener tapes, a stretchable member which is elastically deformed so as to be stretchable in a length direction of the fastener tape is attached to an edge side of the fastener tape on an opposite side to the convex element attaching edge portion, and the stretchable member is fixed to the fastener tape in a contracted state and maintains a foundation structure of the fastener tape in a contracted state, thereby preventing occurrence of wrinkle or swelling on the tape surface.

2 Claims, 6 Drawing Sheets

CURVED SLIDE FASTENER

BACKGROUND OF THE INVENTION

1. Field of the Invention

The present invention relates to a slide fastener for use in opening and closing an article such as a bag and clothes, and more particularly, to a curved slide fastener whose fastener tape is curved at a predetermined curvature in the horizontal direction with respect to a tape surface thereof.

2. Description of the Related Art

As a slide fastener to be attached to open and close an opening portion of a bag, the front of clothes and fly of trousers, a curved slide fastener in which a fastener tape thereof is curved at a predetermined curvature in the horizontal direction with respect to the tape surface thereof is sometimes used. In such a curved slide fastener, usually, a fastener tape is woven or knitted continuously into a linear shape and cut to a predetermined length, followed by deformation into a curved shape.

Generally, in weaving or knitting a tape such that it is curved at a predetermined curvature, plural warp yarns running linearly in parallel in a weaving direction or a knitting direction are poor in elasticity, so that only by adjusting yarn tension to be applied in the weaving direction or the knitting direction, the tape cannot be curved horizontally with respect to the tape surface. Further, even if a warp yarn having an elasticity is used, not only tension control is complicated but also complicatedness in various maintenances is induced, thereby disabling effective manufacturing of such a fastener.

A curved slide fastener whose fastener tape is deformed into the curved shape as described above has been disclosed in U.S. Pat. No. 3,003,212. The curved slide fastener disclosed in U.S. Pat. No. 3,003,212 is composed of a pair of opposing herringbone weaves. Of first and second fastener tapes different in length, in the longer first fastener tape, a shorter cord (core thread) than the length of the fastener tape is sewed along a fastener element attaching edge portion thereof, while in the shorter second fastener tape opposing the first fastener element attaching edge portion, a longer cord (core thread) than the length of the fastener tape is sewed along a fastener element attaching edge portion thereof. With this configuration, when element rows attached to the respective fastener element attaching edge portions are engaged, the fastener tape is curved in a single direction. Further, it is permissible to attach a shorter cord or belt than the length of the second fastener tape along the side edge portion of the second fastener tape on the side in which no cord is sewed.

On the other hand, Japanese Patent Publication No. 7-59205 has disclosed that solvent swellable synthetic fibers, for example, polyurethane fibers are woven or knitted into fastener tapes, and when a solvent is applied only to the one fastener tape, polyurethane fibers of the one fastener tape are swollen so that only the one fastener tape is expanded in the warp direction, thereby reshaping a slide fastener into a curved form. Further Japanese Patent Publication No. 7-59205 has disclosed fixing of the curved form by applying a hot melting type adhesive agent to the fastener tape after the slide fastener is reshaped into a curved form.

Although the aforementioned curved slide fasteners disclosed in U.S. Pat. No. 3,003,212 and Japanese Patent Publication No. 7-59205 have such an advantage that the curved shape of the fastener tape is always maintained stably, each of them has the following disadvantages.

In the curved slide fastener described in U.S. Pat. No. 3,003,212, the longer cord (core thread) than the fastener tape or the shorter cord than the fastener tape is attached along the fastener element attaching edge or its opposite side edge. Thus, it comes that the fastener tape is elongated or contracted forcibly to cope with the length of the cord. For this reason, even a fastener tape with a herringbone weave, there is a problem that wrinkle or wavy uneven surface occurs on the tape surface other than the portion on which the cord is attached. Moreover, if the cord or belt is sewed to not only a fastener element attaching edge portion but also an opposite side edge portion, the number of parts increases and further processing steps increase, which is disadvantageous economically or in terms of working efficiency.

Because the curved slide fastener described in Japanese Patent Publication No. 7-59205 described above is swollen by applying a solvent to the solvent swellable fibers of the one fastener tape so as to elongate the fastener tape in the warp direction to reshape the curved configuration, the degree of swelling needs to be controlled appropriately such that the solvent swellable fibers are swollen by a predetermined amount. However, the degree of the swelling is likely to change depending on the working environment, the physical property of the solvent swellable fibers, the amount of the solvent applied, and the like. Therefore, it is difficult to obtain a curved slide fastener which is curved at a predetermined curvature.

SUMMARY OF THE INVENTION

Accordingly, the present invention has been achieved in view of the above-described problem, and an object of the invention is to provide a curved slide fastener whose fastener tape has a curved shape, the curved slide fastener having a simple structure and being easy to manufacture, in which a wrinkle or wavy uneven surface on the tape surface is securely prevented from occurring.

To achieve the above object, the present invention provides a curved slide fastener comprising element attaching edge portions which have fastener element rows respectively attached along opposing side edge portions of a pair of fastener tapes, being characterized in that at least a partial area of one of the pair of fastener tapes has a first curved portion (A) in which a side edge portion on an opposite side to the element attaching edge portion is curved convexly and outwardly while an area of an other of the fastener tapes opposing the first curved portion (A) has a second curved portion (B) in which the element attaching edge portion is curved convexly toward the element attaching edge portion on an opposing side, and a stretchable member is arranged along an edge portion of the second curved portion (B) on an opposite side to the element attaching edge portion.

Naturally, the first and second curved portions (A) and (B) in the slide fastener of the present invention include a case where the first curved portion (A) is formed continuously throughout the entire length of one of the pair of right and left fastener tapes while the second curved portion (B) is formed continuously throughout the entire length of the other fastener tape, and also includes a case where both the pair of fastener tapes have the first curved portion (A) and the second curved portion (B) alternately in the length direction. In any case, in the entire length of the pair of fastener tapes, the first and/or second curved portions (A)/(B) one of the fastener tapes is/are in a relationship opposing the second and/or first curved portions (B)/(A) of a mating fastener tape.

The characteristic feature of the present invention exists in that when the stretchable member is disposed along the edge portion of the second curved portion (B) of the fastener tape on the opposite side to the element attaching edge portion, the stretchable member is fixed to a straight fastener tape in an elongated state.

In the curved slide fastener of the present invention having such a configuration, a force of contracting the fastener tape is applied by the stretchable member. Consequently, the fastener tape is curved convexly toward the element attaching edge portion of a mating fastener tape to form the second curved portion (B). Now, when the element row of the element attaching edge portion of the second curved portion (B) of the fastener tape is engaged with the element row of the element attaching edge portion of the mating fastener tape, the mating fastener stringer follows up the curved shape of the second curved portion (B) of the mating fastener stringer in the engagement area, so that the tape side edge on the opposite side to the element attaching edge portion is curved convexly and outwardly so as to form the first curved portion (A). As a result, when the element rows of the respective fastener stringers are in an engagement state, the first and second curved portions (A) and (B) maintain a curved shape which is entirely curved in a single direction.

At this time, the second curved portion (B) contracts the tape edge portion of the fastener tape on the opposite side to the element attaching edge portion on the basis of the contraction of the stretchable member. Consequently, the foundation structure of the fastener tape is deformed to absorb wrinkles or swelling on the tape surface, thereby forming a flat tape surface. On the other hand, the element attaching edge portion of the first curved portion (A) integrated with the second curved portion (B) as a result of engagement is curved following up the curved shape of the second curved portion (B), so that the tape edge portion on the opposite side to the element attaching edge portion is projected convexly and outwardly to provide such a curved shape.

In the case where the first curved portion (A) and the second curved portion (B) are alternately formed in the longitudinal direction of the fastener tape, when the stretchable members may be fixed along the tape edge portion of the second curved portion (B) on the opposite side to the element attaching edge portion at a required interval in an elongated state, the two fixed portions are curved convexly such that respective element attaching edge portions are projected outward due to the contraction of the stretchable members so as to form the second curved portion (B). Accompanied by this curve, a portion between the two second curved portions (B,B) is curved in an opposite direction, that is, the tape edge portion on the opposite side to the element attaching edge portion is curved convexly and outwardly so as to form the first curved portion (A). Consequently, a fastener tape entirely curved into a substantially S shape is formed.

In the curved slide fastener of the present invention, preferably, the stretchable member is a belt material containing elastic fibers stretchable in a warp direction as composition fibers and is bonded along the edge portion of the second curved portion (B) on the opposite side to the element attaching edge portion. At this time, the stretchable belt material is bonded along the tape edge portion of the second curved portion (B) on the opposite side to the element attaching edge portion in an elongated state.

Consequently, a stretchable area of a predetermined width can be easily formed on the tape surface of the fastener tape, so that the stretchable member and the fastener tape can be fixed firmly.

Preferably, each fastener tape is a knitted tape and that a foundation structure of a side edge portion of the first curved portion (A) on an opposite side to the element attaching edge portion is formed into a roughest structure as compared with the foundation structure of other portions.

Particularly, when the curved slide fastener of the present invention is manufactured of a knitted tape, the gap in the foundation structure on the edge portion on the opposite side to the element attaching edge portion is formed larger than the gap in the other area. By doing so, knitting yarns in an area having such a large gap move so that the fastener tape becomes easy to deform. As a result, even when the edge portion of the second curved portion (B) on the opposite side to the element attaching edge portion is contracted, the gap is narrowed to block occurrence of wrinkles or swelling on the tape surface. Further, even when the edge portion of the first curved portion (A) on the opposite side to the element attaching edge portion is elongated, the gap is enlarged so that the fastener tape is deformed easily following up a curved shape of the second curved portion (B). The effects which the present invention exerts are considerably great.

DESCRIPTION OF THE PREFERRED EMBODIMENTS

Hereinafter, the present invention will be described specifically based on embodiments with reference to the accompanying drawings. In the meantime, the present invention is not restricted to embodiments described below but may be modified in various ways within the range not departing from the spirit of the invention. For example, the configuration of the fastener element is not restricted to a coil-like continuous linear fastener element composed of a synthetic resin wire rod, but may be a zigzag-like continuous linear fastener element, a synthetic resin made fastener element fixed at a predetermined interval in the length direction of the fastener tape by injection molding, or a metallic fastener element fixed by cramp.

First Embodiment

Figure 1:
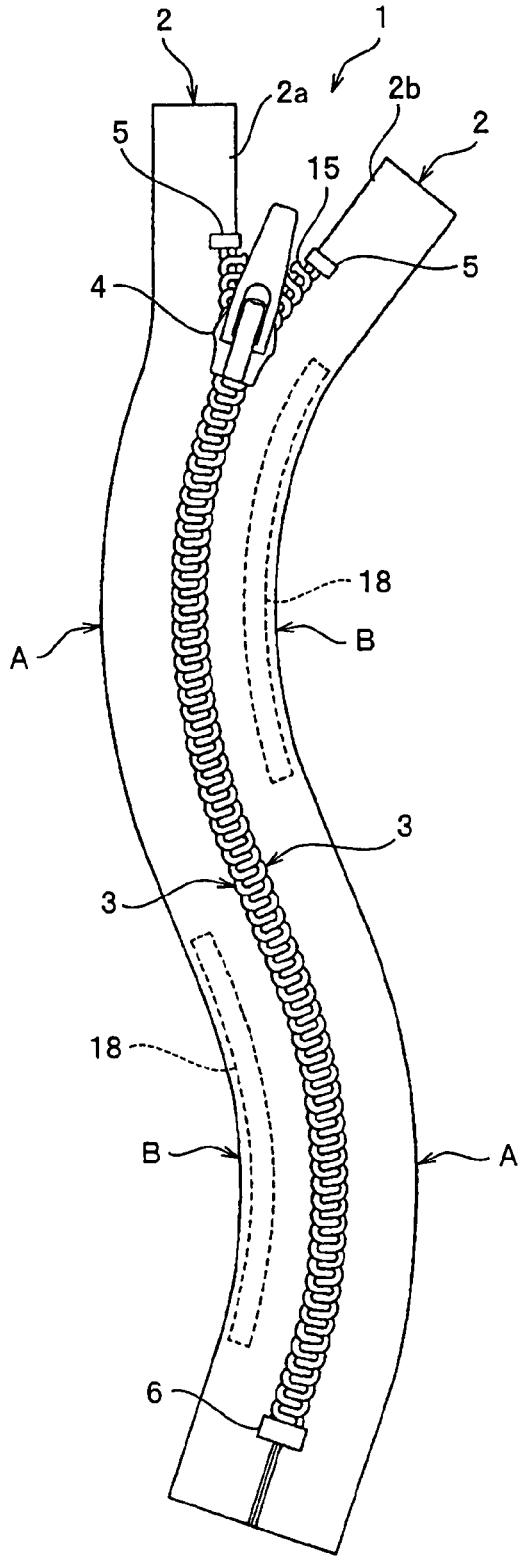
FIG. 1 is a front view of a curved slide fastener according to a first embodiment.
Figure 2:
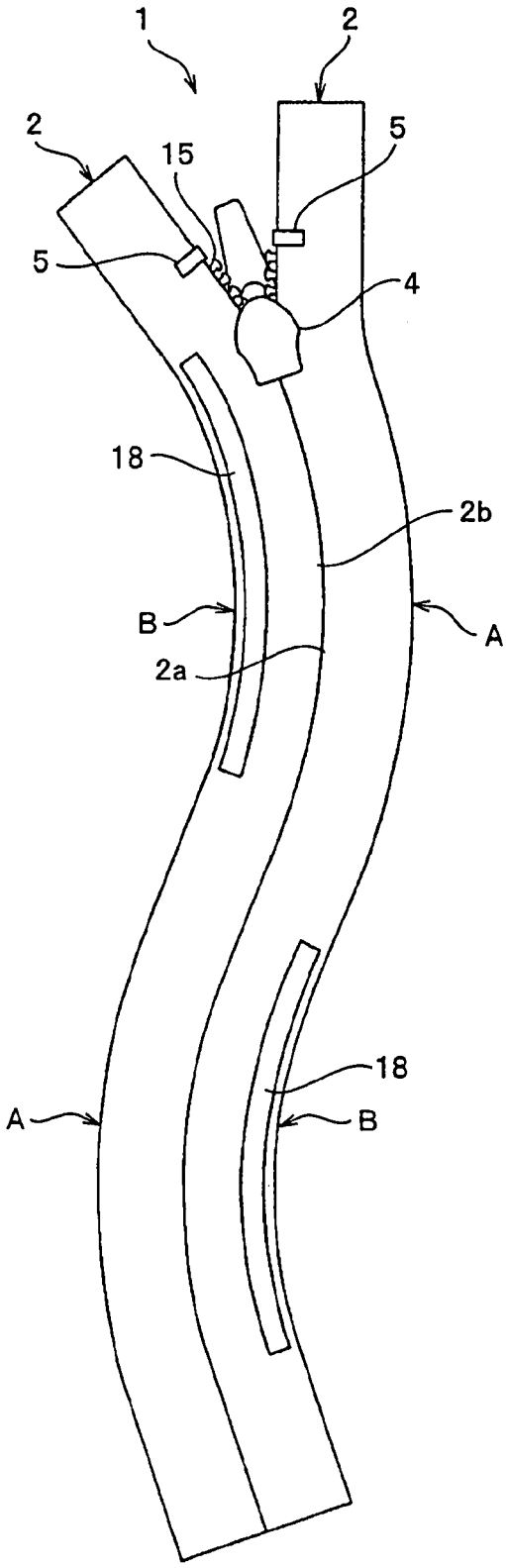
FIG. 2 is a rear view of the curved slide fastener.
Figure 3:
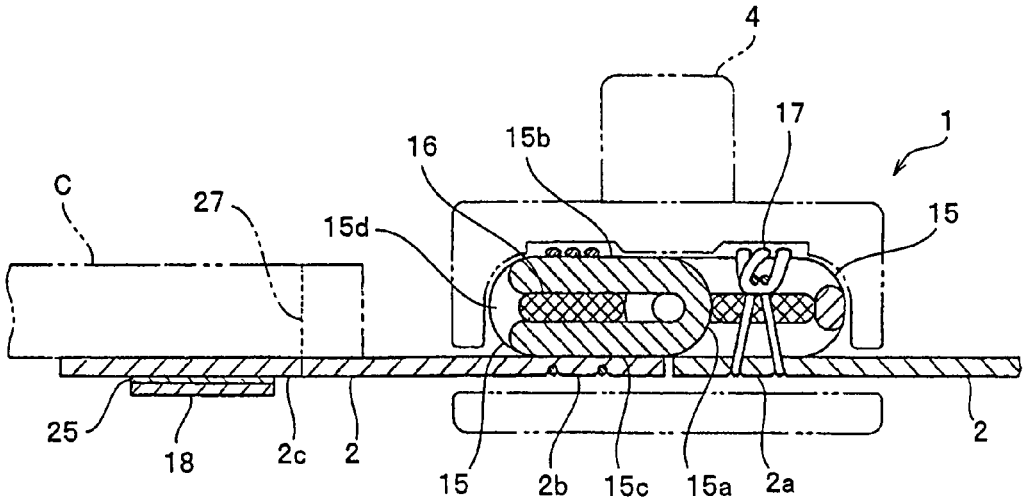
FIG. 3 is a longitudinal sectional view of major portions of the curved slide fastener.

FIG. 1 is a front view of a curved slide fastener according to a first embodiment of the present invention. FIG. 2 is a rear view of the curved slide fastener according to the first embodiment. FIG. 3 is a longitudinal sectional view of major portions of the curved slide fastener.

The curved slide fastener 1 of the first embodiment comprises a pair of right and left fastener tapes 2, 2, fastener element rows 3, 3 and a slider 4 as shown in FIG. 1. The fastener element rows 3, 3 are attached along opposing side edges of the fastener tapes 2, 2. The slider 4 slides along the fastener element rows 3, 3 to engage or disengage the fastener element rows 3, 3. Top end stops 5, 5 are fixed at the top ends of the fastener element rows 3, 3 and a bottom end stop 6 is fixed at the bottom ends of the fastener element rows 3, 3 so as to block the slider 4 from slipping out from the top end and bottom end of the fastener element row 3. Note that, in some cases, an opening device or an inverted opening device (not shown) having an insert pin and a box pin may be fixed instead of the bottom end stop 6.

The fastener tape 2 presents a substantially S-shaped curved configuration within an identical horizontal plane to a tape surface of the fastener tape 2 as shown in FIGS. 1, 2. The fastener tapes 2, 2 have opposing side edges. More specifically, there are arranged a first curved portion A in which a tape edge portion on the opposite side to one element attaching edge portion 2*a* is curved convexly and outwardly and a second curved portion B in which the other element attaching edge portion 2*b* facing the element attaching edge portion 2*a* is convexly and outwardly such that the first and second curved portion A and B face each other, and they are disposed alternately along the longitudinal direction of the tape.

According to this embodiment, a stretchable member 18 is fixed along a tape edge portion of the second curved portion B on the opposite side to the element attaching edge portion 2*b*. The stretchable member 18 is composed of a belt material 19 in which elastic yarns stretchable in the warp direction are disposed in part or all area thereof.

Figure 4:
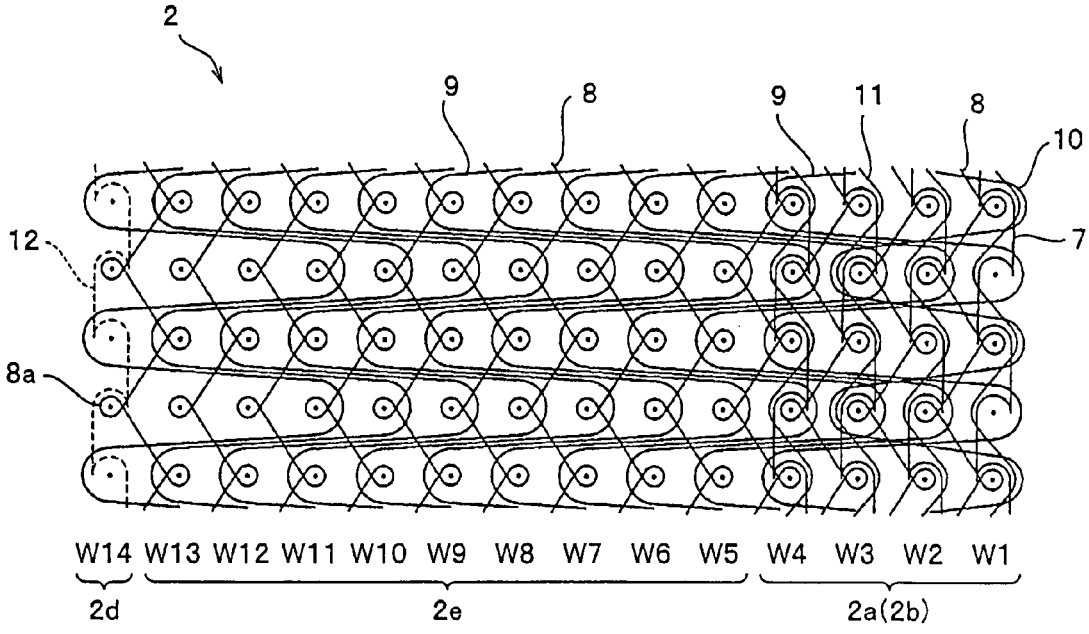
FIG. 4 is a structure diagram of a fastener tape.

As shown in FIG. 4, the fastener tape 2 of this embodiment is constituted of a warp knitted tape knitted with plural knitting yarns. The element attaching edge portions 2*a*, 2*b* are formed in first to fourth wales W1 to W4 along the opposing side edges of the right and left fastener tapes 2, 2, other fifth to thirteenth wales W5 to W13 form tape main body portions 2*e*, 2*e*, and a fourteenth wale W14 formed on the outermost edge portion on the opposite side to the element attaching edge portions 2*a*, 2*b* forms an ear portion 2*d*. The foundation structure of the right and left element attaching edge portions 2*a*, 2*b* is comprised of a chain yarn 7 having the 0-1/1-0 knitting structure, a tricot knitting yarn 8 having the 1-0/1-2 knitting structure, a weft in-laid yarn 9 having the 4-4/0-0 knitting structure, a weft in-laid yarn 10 having the 0-0/3-3 knitting structure, and a warp in-laid yarn 11 having the 0-0/1-1 knitting structure. On the other hand, the foundation structure of the tape main body portion 2*e* and the ear portion 2*d* is comprised of the tricot knitting yarn 8 having the 1-0/1-2 knitting structure and the weft in-laid yarn 9 having the 4-4/0-0 knitting structure. By forming the fastener tape 2 with the knitting structure of the above-described foundation structure, a gap is formed between the knitting yarns, and when the stretchable member 18 is attached in an elongated state, the knitting yarn of the foundation structure moves within the gap according to the stretching action of the stretchable member 18 so that it is easy to deform.

As these knitting yarns, synthetic fiber multifilament composed of polyester or nylon is used.

When the fastener tape 2 is knitted, in addition to the aforementioned knitting structure, a chain knitting yarn 12 having the 0-1/1-0 knitting structure is knitted in the ear portion 2*d*. The chain knitting yarn 12 is water-soluble yarn and can be melted by dipping into water after the fastener tape 2 is knitted. In the ear portion 2*d* in which no chain knitting yarn 12 exists, no stitch of the chain knitting yarn 12 exists. Instead, the foundation structure having a wide gap between adjacent stitches 8*a* in the wale direction (length direction of the fastener tape) is formed such that a stitch 8*a* of the tricot knitting yarn 8 remains, that is, the stitch is eliminated in every course. Consequently, the ear portion 2*d* turns to be the roughest foundation structure containing fewer yarns than the element attaching edge portion 2*a*, 2*b* and the tape main body portion 2*e*. When the fastener tape 2 is deformed into a curved shape by being elongated or stretched in the length direction, the fastener tape 2 is deformed while easily expanding or narrowing the gap between the stitches 8*a*.

Figure 5:
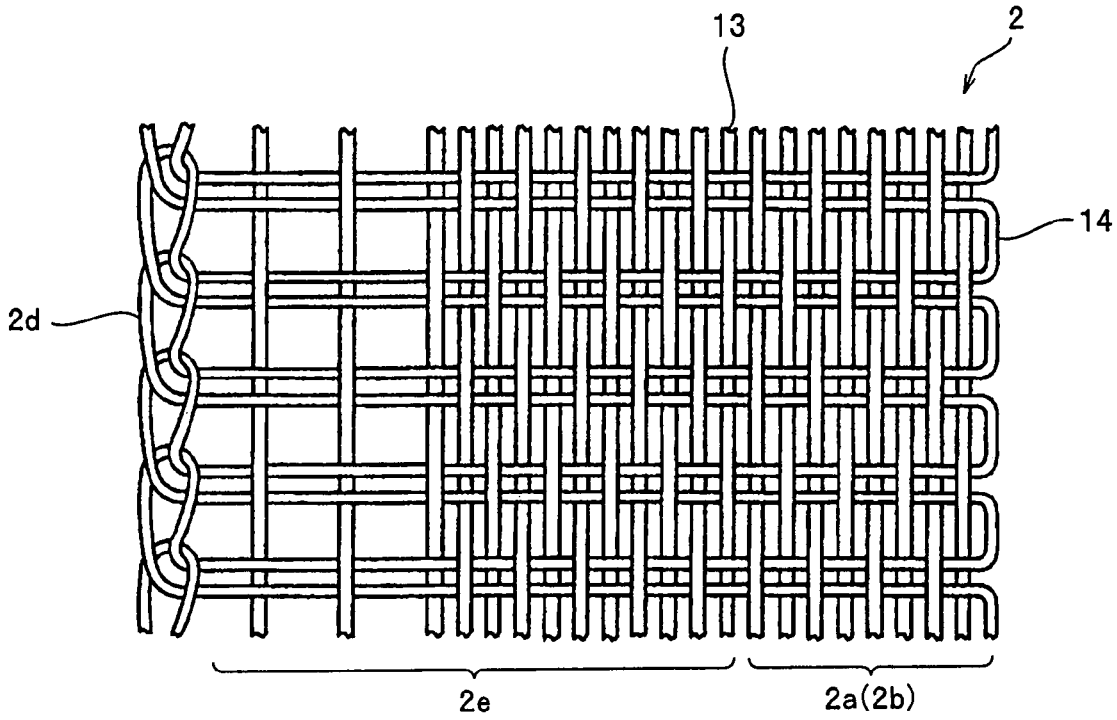
FIG. 5 is a front view showing a modification of the fastener tape.

As shown in FIG. 5, the fastener tape 2 may be woven with a warp yarn 13 and a weft yarn 14. The element attaching edge portion 2*a*, 2*b* is formed along one side edge of the fastener tape 2 and the tape main body portion 2*e* is formed in the other portion while the ear portion 2*d* is formed on the edge portion of the tape main body portion 2*e* on the opposite side to the element attaching edge portion 2*a*, 2*b*. The fastener tape 2 is woven such that the number of the warp yarns disposed near the ear portion 2*d* in the tape main body portion 2*e* is smaller than the number of the warp yarns disposed in other portions, and that the portion near the ear portion 2*d* in the tape main body portion 2*e* has a smaller weaving yarn density than the other portions in the tape main body portion 2*e*.

Although the fastener tape shown in the figure is curved into the substantially S-shape, in some case, the one fastener tape 2 is formed of only the second curved portions B in which the element attaching edge portions are curved continuously, convexly and outwardly while the other fastener tape 2 is formed of only the first curved portions A in which the tape edge portions on the opposite side to the element attaching edge portion is curved continuously, convexly and outwardly. That is, in this case, when the fastener elements are engaged with each other, the fastener chain is turned into a single circular curved shape.

In this case, a yarn having a lower elongation recovery rate than other yarns is used as the warp yarn of the tape edge portion of the one fastener tape 2, which constitutes the first curved portion A, on the opposite side to the element attaching edge portion 2*a*, and a yarn having a high heat shrinkage rate is used as the warp yarn on the element attaching edge portion side. Further, a heat shrinkable yarn having the highest heat shrinkage rate of the warp yarns of the both fastener tapes 2, 2 is used as the warp yarn of the tape edge portion of the other fastener tape 2, which constitutes the second curved portion B, on the opposite side to the element attaching edge portion 2*b*. In this case, when heat setting or high temperature dyeing is carried out after the both fastener tapes 2 are elongated by applying a tensile force thereto, the fastener tape having the first curved portion A in which the tape edge portion on the opposite side to the element attaching edge portion is curved convexly and outwardly is formed on the one fastener tape while the other fastener tape 2 having the second curved portion B in which the element attaching edge portion is curved convexly and outwardly is formed. By using such a stretchable member at the same time, a curved slide fastener whose curved shape is clearer with a smaller curvature radius is obtained and no wrinkle such as wavy shape occurs in the fastener tape portion.

The elongation recovery rate can be obtained according to the following equation (1) by measuring each yarn length according to JIS L1096. However, the elongation recovery rate differs depending on the type of the composition yarn of the fastener tape and cannot be automatically determined, but the elongation recovery rate R of ordinary multifilament or monofilament is up to 80% max. However, for example, the elongation recovery rate of the multifilament composed of polyester is 67.0%, which is extremely low as compared with nylon multifilament whose elongation recovery rate is as high as 94.3%:

$$R=\{(L1-L2)/(L1-L0)\}\times 100 \quad (1)$$

where L0 is an original yarn length, L1 is a yarn length when pulled under a predetermined tension, and L2 is a yarn length after recovery under no tension force.

Upon measurement of the yarn length based on JIS L1096, a tensile testing machine or an apparatus having an equivalent performance is used. An end of a test piece is fixed with an upper clamp, the other end is supplied with an initial load, and a position of 20 cm away from the bottom end of the clamp of the test piece is marked. Next, a load of 14.7 N (1.5 kgf) is gently applied to the test piece, and a length between the marks is measured after the test piece is left for an hour. Subsequently, the load is removed, an initial load is applied 30 seconds and an hour later, and the length between the marks is measured again. Then, the elongation recovery rate R (%) is obtained according to the aforementioned equation (1) and an average value of three times is calculated about 30 seconds later and an hour later.

Instead of the above-described fastener tape 2, a portion in which no warp yarn 13 exists may be formed by using water soluble yarns as some warp yarns 13 which constitute the portion near the ear portion 2*d* of the tape main body portion 2*e* of the fastener tape 2, and by dipping the fastener tape 2 after the fastener tape 2 is woven to melt the water soluble yarns. Consequently, the portion near the ear portion 2*d* of the tape main body portion 2*e* turns to the foundation structure in which a wide gap is formed between the weaving yarns, so that when the stretchable member 18 is attached to the portion, the weaving yarns of the foundation structure move within the gap according to the contracting action of the stretchable member, thereby facilitating deformation of the fastener tape.

The fastener element row 3 shown in the figure is formed continuously in its longitudinal direction such that the monofilament made of synthetic resin is wound into a coil shape. Each fastener element 15 which constitutes the fastener element row 3 is comprised of, as shown in FIG. 3, a coupling head 15*a* which engages a mating fastener element 15, upper leg portion 15*b* and lower leg portion 15*c* extending in parallel from the top end and bottom end of the coupling head 15*a*, and an inverted portion 15*d* which connects the upper leg portion 15*b* and the lower leg portion 15*c* of the fastener elements 15 adjacent in the length direction of the fastener element row 3. A core thread 16 is inserted between the upper leg portion 15*b* and the lower leg portion 15*c*, and the core thread 16 and the fastener element 15 are fixed to a tape surface on the front face side of the fastener tape 2 with a sewing yarn 17.

The stretchable member 18 which is stretchable in the length direction of the fastener tape 2 is attached on the edge portion of each fastener tape 2 on the opposite side to the element attaching edge portion 2*b*, i.e., the ear portion 2*d* side, in the length direction or the warp direction of the fastener tape 2 such that the stretchable member 18 faces the tape surface 2*c* on the rear surface side of the fastener tape 2. The stretchable member 18 functions as a reinforcement member for the fastener tape 2 to maintain its curved shape, and the stretchable member 18 is attached to the fastener tape 2 in an elongated state. Usually, the stretchable member 18 is kept contracted to maintain the foundation structure of the fastener tape 2 in a contracted state, thereby preventing generation of wrinkle or wavy swelling on the tape surface 2*c* of the second curved portion B.

The stretchable member 18 can be elongated according to deformation of the fastener tape 2 when a tensile force is applied in the length direction of the fastener tape 2. When the tensile force is released, the stretchable member 18 is elastically restored to its original contracted state. Consequently, because the stretchable member 18 can be elastically deformed into a state elongated in the length direction of the fastener tape 2, the curved slide fastener 1 can be elongated according to a tensile force applied when the curved slide fastener 1 is sewed to an article. Even if the fastener tape 2 is sewed to the article such that the fastener tape 2 is deformed into a curved state at a slightly different curvature from its original curved shape, little wrinkle or swelling is generated on the tape surface, so that a flat state can be maintained.

Figure 6:
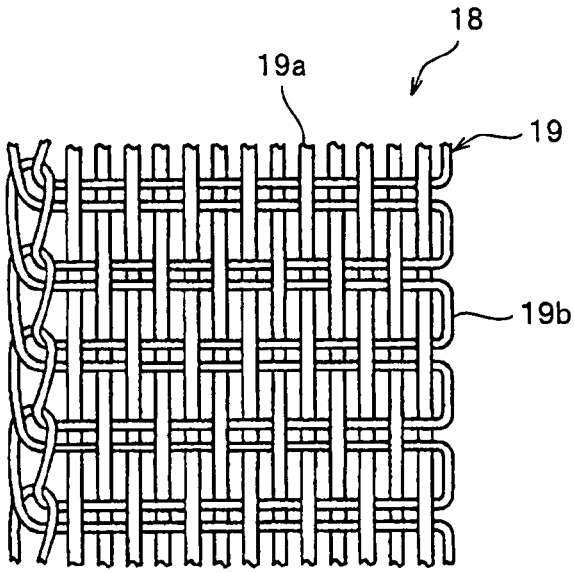
FIG. 6 is a partially enlarged front view showing a stretchable member.

The stretchable member 18 is constituted of a belt material 19 woven with a warp yarn 19*a* and a weft yarn 19*b* as shown in FIG. 6, and an elastic yarn is used as the warp yarn 19*a*, so that the stretchable member 18 can be elongated and contracted in the length direction or the warp direction of the belt material 19. An adhesive layer 25 composed of a polyester base or nylon base hot melt adhesive agent is provided on the rear surface of the belt material 19, that is, the surface facing the tape surface 2*c* of the fastener tape 2. The adhesive layer 25 is bonded to the tape surface 2*c* so as to fix the stretchable member 18 onto the fastener tape 2. Note that the material of the adhesive layer 25 is preferred to be of the same material as the fastener tape 2 in order to intensify the adhesive strength to the fastener tape 2.

Figure 7:
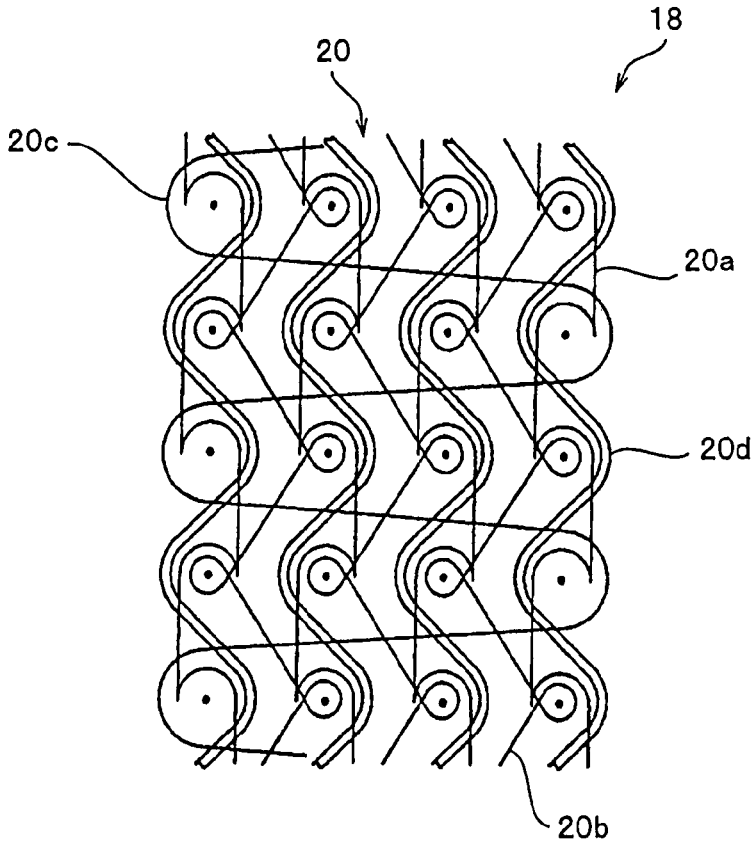
FIG. 7 is a structure diagram showing a modification of the stretchable member.

The stretchable member 18 may be of a belt material 20 knitted with a chain knitting yarn 20*a* having the 0-1/1-0 knitting structure, a tricot knitting yarn 20*b* having the 1-0/1-2 knitting structure, a weft in-laid yarn 20*c* having the 4-4/0-0 knitting structure and a warp in-laid yarn 20*d* having the 0-0/1-1 knitting structure as shown in FIG. 7 as another configuration. An elastic yarn is used as the warp in-laid yarn 20*d* of the above-mentioned knitting yarns, and the belt material 20 is formed so as to be stretchable in the length direction or the warp direction thereof.

Figure 8:
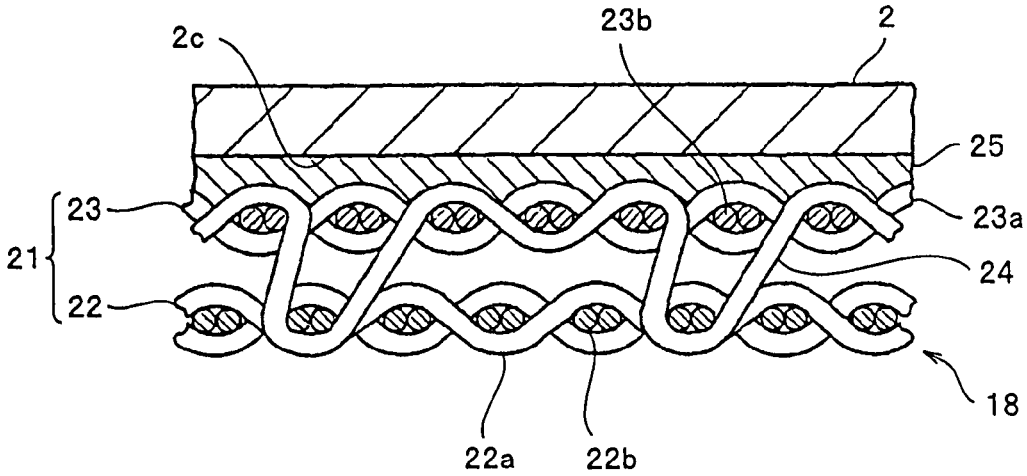
FIG. 8 is a sectional view showing a side portion of another modification of the stretchable member.

As still another configuration of the stretchable member 18, as shown in FIG. 8, a belt material 21 having the two-layer structure comprising a front cloth 22 and a rear cloth 23 may be adopted. The front cloth 22 is woven with a warp yarn 22*a* and a weft yarn 22*b*, and the rear cloth 23 is woven with a warp yarn 23*a* and a weft yarn 23*b*. The front cloth 22 and the rear cloth 23 are joined together with a connecting yarn 24. The front cloth 22 and the rear cloth 23 may be joined by bonding their opposing faces instead of the connecting yarn 24 partially. In the belt material 21, an elastic yarn is used as at least the warp yarn 22*a* of the front cloth 22 of the warp yarn 22*a* of the front cloth 22 and the warp yarn 23*a* of the rear cloth 23. Consequently, the belt material 21 is formed so as to be elongated and contracted in the length direction or the warp direction thereof. Additionally, the adhesive layer 25 composed of a hot melt adhesive agent is provided on a surface of the rear cloth 23 facing the tape surface 2*c* of the fastener tape 2, so that the adhesive layer 25 is bonded to the tape surface 2*c*.

Figure 9:
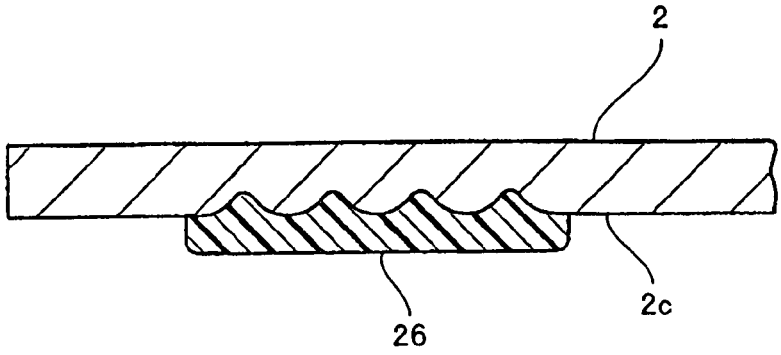
FIG. 9 is a longitudinal sectional view showing still another modification of the stretchable member.

As a further another configuration of the stretchable member 18, the stretchable member 18 may be formed by coating the tape surface 2*c* of the fastener tape 2 with a rubber made belt material 26 continuously in the length direction of the fastener tape 2 in a belt-like formation as shown in FIG. 9. The belt material 26 is applied to the fastener tape 2 by coating in a state in which the rubber is heated to be softened, so that the rubber invades in between fibers of the fastener tape 2 and fixed integrally with the fastener tape 2. Thus, no adhesive layer is needed to fix the belt material 26 to the fastener tape 2.

The stretchable member 18 is formed into a belt shape. A stretchable area of a predetermined width dimension can be provided easily in the width direction of the tape main body portion 2*e* of the fastener tape 2 by attaching the stretchable member 18 to the tape surface 2*c* of the fastener tape 2. Further, this can deform the foundation structure of the tape main body portion 2*e* in a wide range so as to securely absorb wrinkle or swelling generated on the tape surface 2*c*.

By attaching the stretchable member 18 on the side of the ear portion 2*d* in the tape main body portion 2*e*, sewed line located substantially in the center of the tape main body portion 2*e* is prevented from overlapping a position where the stretchable member 18 is attached when the fastener tape 2 is sewed to a fabric C of an article such as a bag or cloth. Consequently, a sewing yarn 27 for fixing the fastener tape 2 to an article is prevented from piercing the stretchable member 18, so that the stretchable member 18 is never an obstacle to sewing or the stretching function of the stretchable member 18 is never deteriorated by the sewing thread 27.

Second Embodiment

Figure 10:
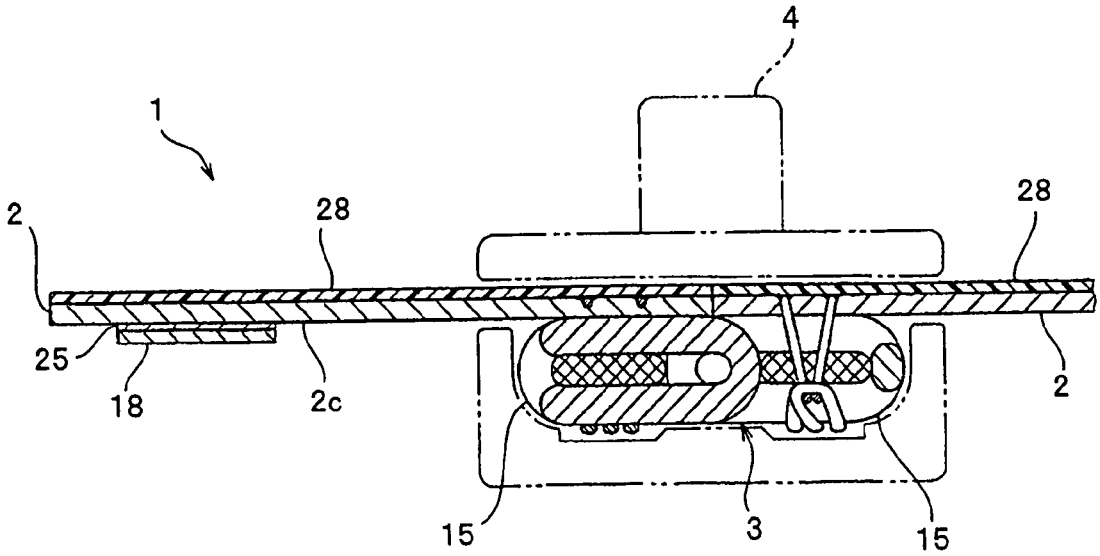
FIG. 10 is a longitudinal sectional view of major portions of a curved slide fastener according to a second embodiment.

FIG. 10 is a longitudinal sectional view of major portions of a curved slide fastener according to a second embodiment of the present invention. According to this embodiment, in order to form the waterproof slide fastener into the curved configuration like the first embodiment, the stretchable member 18 is attached on the side of the ear portion 2*d* of the tape surface 2*c* of the fastener tape 2. The stretchable member 18 is of a woven or knitted belt material and bonded to the tape surface 2*c* on the rear surface side of the fastener tape 2 with the adhesive layer 25 composed of a hot melt adhesive agent. The fastener element row 3 is disposed on the tape surface 2*c* on the rear surface side of the fastener tape 2.

A waterproof layer 28 is formed on the front surface of the fastener tape 2. The waterproof layer 28 covers the entire front surface of the fastener tape 2 so as to block water from penetrating from the front surface side of the fastener tape 2 to the rear surface side thereof and is formed by using a synthetic resin material having elasticity, such as polyurethane resin. Because the gap of the foundation structure of the fastener tape 2 is filled with polyurethane resin for forming the waterproof layer 28, the weaving yarn or knitting yarn of the foundation structure cannot move within the gap to deform the fastener tape. However, the waterproof layer 28 itself can be elastically deformed. For this reason, the waterproof layer 28 is deformed in the length direction of the fastener tape 2 according to elongation or contraction of the stretchable member 18, so that the normal shape of the waterproof layer 28 is maintained with the stretchable member 18 contracted.

The present invention can be applied to a slide fastener which is attached to an opening of a bag or clothes so as to open or close the opening and which can provide a change to the opening shape of the opening, thereby presenting beautiful appearance.

What is claimed is:

1. A curved slide fastener comprising element attaching edge portions which have fastener element rows respectively attached along opposing side edge portions of a pair of fastener tapes, wherein at least a partial area of one of the pair of fastener tapes has a first curved portion (A) in which a side edge portion on an opposite side to the element attaching edge portion is curved convexly and outwardly while an area of an other of the fastener tapes opposing the first curved portion (A) has a second curved portion (B) in which the element attaching edge portion is curved convexly toward the element attaching edge portion on an opposing side, and a stretchable member is arranged along an edge portion of the second curved portion (B) on an opposite side to the element attaching edge portion, and the stretchable member is a belt material which stretches in a longitudinal direction, and wherein the belt material stretchable member is a belt material containing elastic fibers stretchable in a warp direction as composition fibers and is bonded along the edge portion of the second curved portion (B) on the opposite side to the element attaching edge portion.

2. The curved slide fastener according to claim 1, wherein each fastener tape is a knitted tape and that a foundation structure of a side edge portion of the first curved portion (A) on an opposite side to the element attaching edge portion is formed into a roughest structure as compared with the foundation structure of other portions.

* * * * *